US007185615B2

(12) United States Patent
Sato et al.

(10) Patent No.: US 7,185,615 B2
(45) Date of Patent: Mar. 6, 2007

(54) VARIABLE STROKE ENGINE

(75) Inventors: Yoshikazu Sato, Wako (JP); Sei Watanabe, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 53 days.

(21) Appl. No.: 10/411,392

(22) Filed: Apr. 11, 2003

(65) Prior Publication Data

US 2004/0011307 A1 Jan. 22, 2004

(30) Foreign Application Priority Data

Apr. 17, 2002 (JP) ..... 2002-114271

(51) Int. Cl.
*F02D 15/02* (2006.01)
*F01L 1/04* (2006.01)

(52) U.S. Cl. ..... 123/48 B

(58) Field of Classification Search ..... 123/48 B, 123/73 BA, 197.3–197.4, 572–574, 78 BA
See application file for complete search history.

(56) References Cited

U.S. PATENT DOCUMENTS 1,174,801 A * 3/1916 Babcock ..... 123/78 F
4,050,435 A * 9/1977 Fuller et al. ..... 123/198 F
4,517,931 A 5/1985 Nelson
4,714,058 A * 12/1987 Oda et al. ..... 123/90.22
4,852,527 A * 8/1989 Beardmore et al. ..... 123/90.6
4,926,814 A * 5/1990 Bonde ..... 123/196 W
4,958,613 A * 9/1990 Hiraoka et al. ..... 123/572
5,230,317 A * 7/1993 Nonogawa et al. ..... 123/432
5,415,138 A * 5/1995 Hudson ..... 123/90.43
5,617,834 A * 4/1997 Lohr ..... 123/572
5,732,670 A * 3/1998 Mote, Sr. ..... 123/90.24
6,044,828 A * 4/2000 Matsushita ..... 123/572
6,394,079 B2 * 5/2002 Takada et al. ..... 123/572
6,505,582 B2 * 1/2003 Moteki et al. ..... 123/48 B
6,505,589 B1 * 1/2003 Hayman et al. ..... 123/90.23
6,536,393 B2 * 3/2003 Novak et al. ..... 123/182.1
6,546,900 B2 * 4/2003 Arai et al. ..... 123/48 B
6,561,142 B2 * 5/2003 Moteki et al. ..... 123/48 B (Continued)

FOREIGN PATENT DOCUMENTS

EP 1 130 225 A1 9/2001

(Continued)

OTHER PUBLICATIONS

European Search Report.

*Primary Examiner*—Marguerite McMahon
(74) *Attorney, Agent, or Firm*—Arent Fox PLLC

(57) ABSTRACT

A variable stroke engine includes a connecting rod having one end thereof connected to a piston via a piston pin. A sub-rod is connected to a crankshaft via a crankpin and to the other end of the connecting rod. A control rod has one end thereof connected to the sub-rod at a position distal from the position where the sub-rod is connected to the connecting rod. An eccentric shaft is connected to the other end of the control rod. The eccentric shaft is provided at a position eccentric relative to a rotating shaft to which power is transmitted from the crankshaft at a reduction ratio of ½. Intake and exhaust cams form a part of a valve operating mechanism and are provided on the rotating shaft.

38 Claims, 5 Drawing Sheets

U.S. PATENT DOCUMENTS

| | | | | |
|---|---|---|---|---|
| 6,622,670 | B2 * | 9/2003 | Hiyoshi et al. | 123/48 B |
| 6,779,495 | B2 * | 8/2004 | Yamada et al. | 123/78 E |

FOREIGN PATENT DOCUMENTS

| | | |
|---|---|---|
| EP | 1 178 194 A2 | 2/2002 |
| JP | 61149525 | 7/1986 |
| JP | 2000-045714 | 2/2000 |
| WO | WO 02/23026 A1 | 3/2002 |

* cited by examiner

VARIABLE STROKE ENGINE

BACKGROUND OF THE INVENTION

1. Field of the Invention

The present invention relates to a variable stroke engine having a connecting rod with one end thereof connected to a piston via a piston pin, a sub-rod connected to a crankshaft via a crankpin and to the other end of the connecting rod, and a control rod with one end thereof connected to the sub-rod at a position distal from the position where the connecting rod is connected. In particular, the present invention relates to a variable stroke engine also having an eccentric shaft connected to the other end of the control rod, wherein the eccentric shaft is provided at a position eccentric relative to a rotating shaft to which power is transmitted from the crankshaft at a reduction ratio of ½.

2. Description of the Related Art

Conventionally, such a variable stroke engine is known, such as, for example, the engine disclosed in U.S. Pat. No. 4,517,931 to Nelson.

In the case of a DOHC or SOHC variable stroke engine, rotational power is generally transmitted from the crankshaft to a camshaft supported on a cylinder head at a reduction ratio of ½ using a timing belt and the like. In the case of an OHV variable stroke engine, a camshaft is generally provided to which power is transmitted from the crankshaft at a reduction ratio of ½ by a reduction gear, in addition to a rotating shaft, to which power is transmitted from the crankshaft at a reduction ratio of ½.

It is therefore necessary in conventional DOHC and SOHC variable stroke engines to provide space for the camshaft above the cylinder head, which results in an increase in the overall dimensions of the engine. In the conventional OHV variable stroke engine, a reduction gear positioned between the crankshaft and the camshaft causes mechanical noise, and the overall complicated structure of the engine increases friction loss.

SUMMARY OF THE INVENTION

It is an object of the present invention to overcome the deficiencies of the above-described conventional variable stroke engines.

It is also an object of the present invention to provide a variable stroke engine that reduces the overall dimensions of the engine, reduces the number of structural components, and concurrently reduces the amount of mechanical noise and friction loss.

In order to accomplish these and other objects, in accordance with a first aspect of the present invention, a variable stroke engine includes a connecting rod with one end thereof connected to a piston via a piston pin, a sub-rod connected to a crankshaft via a crankpin and to the other end of the connecting rod, a control rod with one end thereof connected to the sub-rod at a position distal from the position where the connecting rod is connected, and an eccentric shaft that is connected to the other end of the control rod. The eccentric shaft is provided at a position eccentric relative to a rotating shaft to which power is transmitted from the crankshaft at a reduction ratio of ½. A cam, which forms a part of a valve operating mechanism, is provided on the rotating shaft.

In accordance with such an arrangement, because the cam is provided on the rotating shaft having the eccentric shaft, it is unnecessary to use a camshaft and rotating shaft. As a result, the total number of structural components is reduced. Further, space is not required to be provided to arrange the camshaft, thereby reducing the overall dimensions of the engine. Furthermore, since a dedicated camshaft is not needed, a power transmission mechanism is not required to be positioned between the crankshaft and the dedicated camshaft, thereby reducing the amount of mechanical noise and friction loss.

Furthermore, in accordance with a second aspect of the present invention, in addition to the arrangement of the first aspect, a variable stroke engine includes an intake cam, an exhaust cam, and an eccentric shaft disposed between the intake and exhaust cams all of which are integrally provided on the rotating shaft. The eccentric shaft has a diameter that covers the entire shape of one of the intake and exhaust cams when viewed from a direction along the axis of the rotating shaft. In accordance with such an arrangement, the eccentric shaft can be provided on the rotating shaft without using a crank arrangement for the rotating shaft, the machining precision of the eccentric shaft and the intake and exhaust cams is improved, and the rotating shaft is formed with relatively low weight and increased rigidity.

The above-mentioned object, other objects, characteristics and advantages of the present invention will become apparent from an explanation of a preferred embodiment described below in detail with reference to the attached drawings.

DESCRIPTION OF PREFERRED EMBODIMENTS

Figure 1:
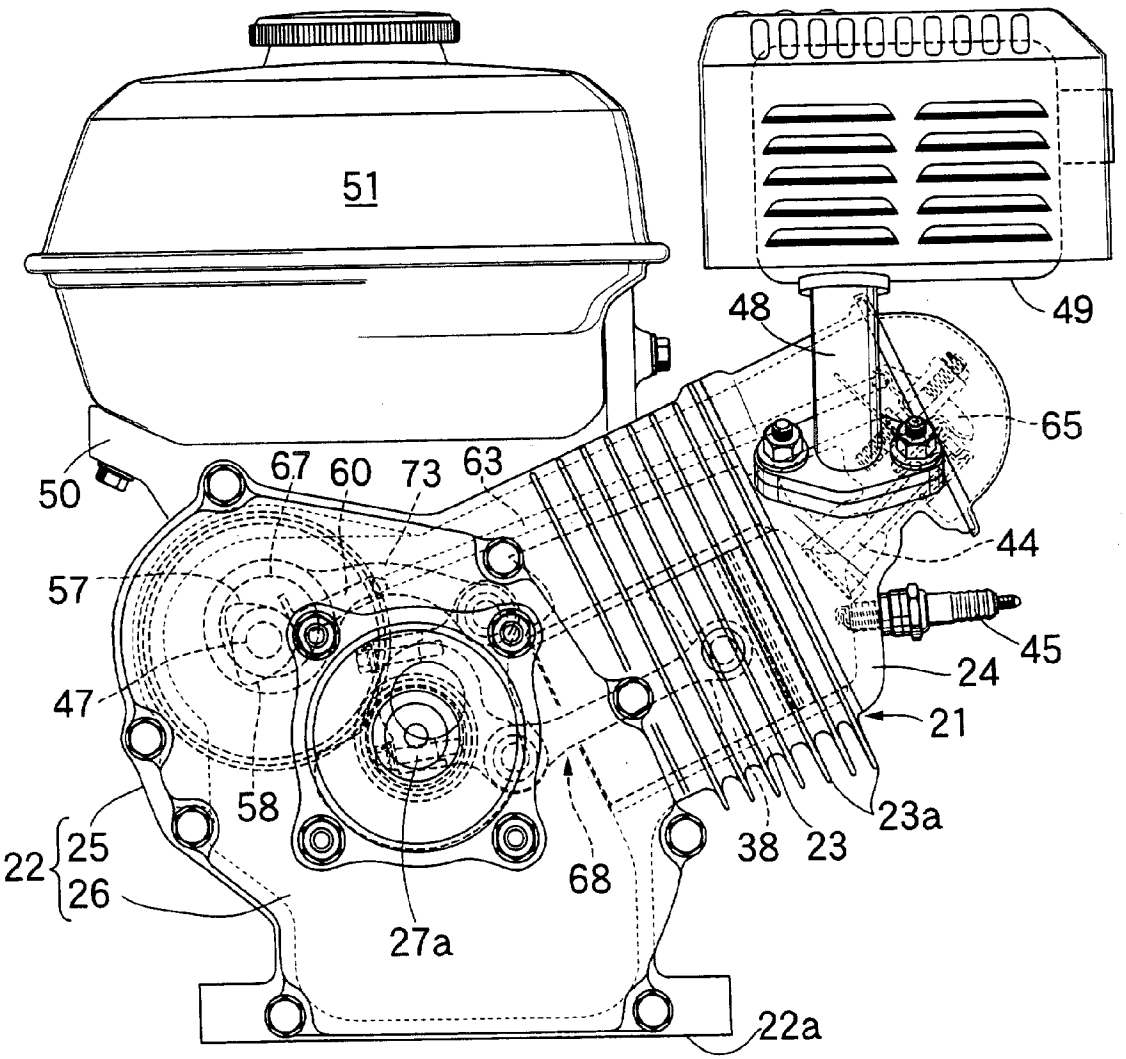
FIG. 1 is a front view of an engine according to a preferred embodiment of the present invention.
Figure 2:
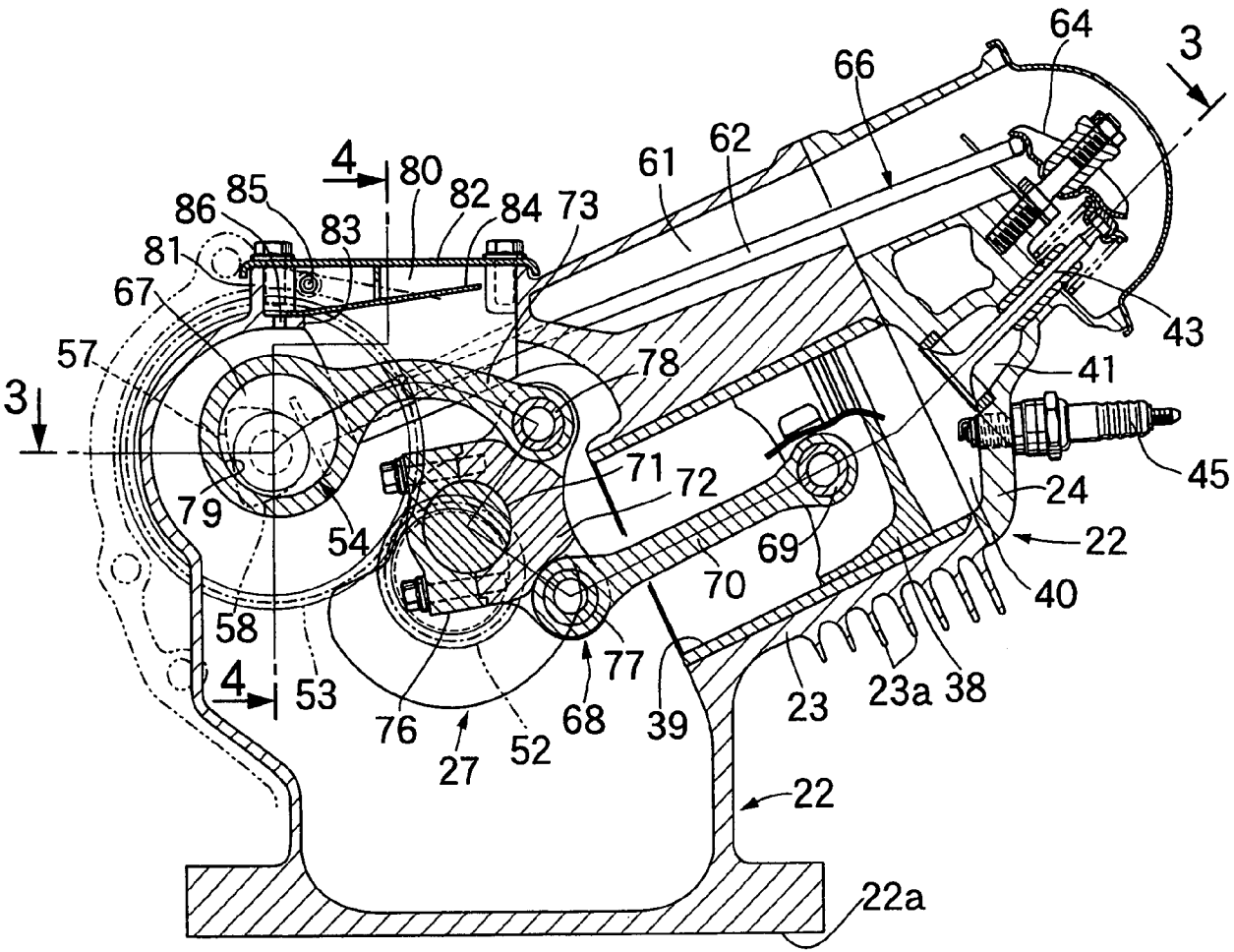
FIG. 2 is a longitudinal cross-sectional view of the engine shown in FIG. 1, taken along line 2—2 in FIG. 3 when viewed from the same direction as in FIG. 1.
Figure 3:
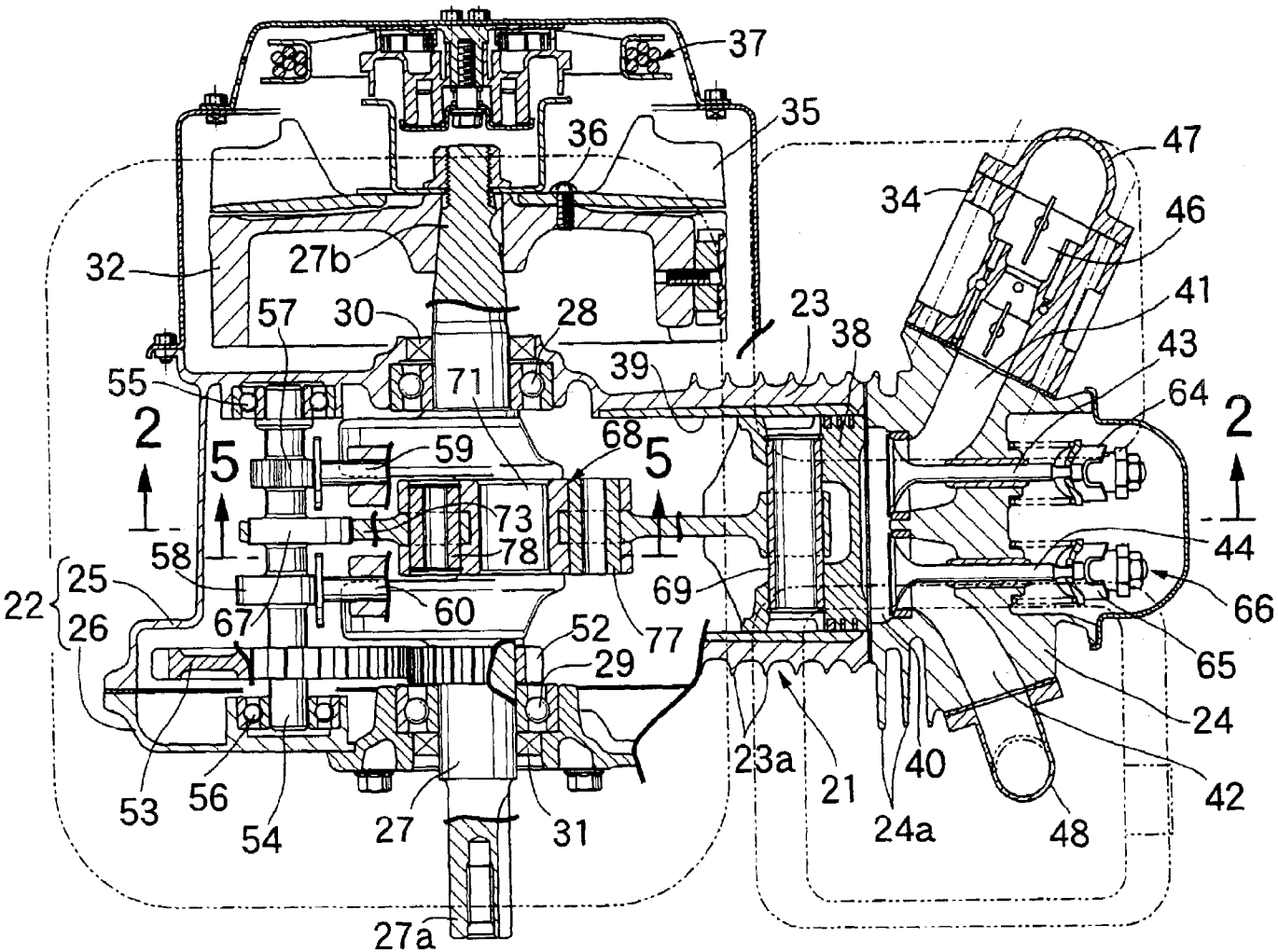
FIG. 3 is a cross-sectional view of the engine shown in FIG. 1, taken along line 3—3 in FIG. 2.

A preferred embodiment of the present invention is explained with reference to FIGS. 1 to 5. Referring to FIGS. 1 to 3, the illustrated engine is an air-cooled single cylinder engine used in, for example, work equipment. An engine main body 21 is formed from a crankcase 22, a cylinder block 23, and a cylinder head 24 joined to the head of the cylinder block 23. The cylinder block 23 is inclined slightly upward and projects from a side face of the crankcase 22. A plurality of air-cooling fins 23*a*, 24*a* are provided on the outer side faces of the cylinder block 23 and the cylinder head 24, respectively. The crankcase 22 is mounted on an engine bed of various types of work equipment via a mounting face 22*a* on a lower face of the crankcase 22.

The crankcase 22 is formed from a case main body 25 and a side cover 26 joined to an open end of the case main body 25. The case main body 25 is integrally mold-cast with the cylinder block 23. Opposite ends of a crankshaft 27 are rotatably supported in the case main body 25 and the side cover 26 via ball bearings 28, 29 and oil seals 30, 31. One end of the crankshaft 27 projects out of the side cover 26 and serves as an output shaft portion 27*a*. The other end of the crankshaft 27 projects out of the case main body 25 and serves as an auxiliary equipment attachment shaft portion 27*b*. A flywheel 32 is fixed to the auxiliary equipment attachment shaft portion 27*b*. A cooling fan 35 is rigidly attached by a screw 36 to the outside surface of the flywheel 32 and supplies cooling air to each part of the engine main body 21 and a carburetor 34. A recoil type engine starter 37 is disposed outside the cooling fan 35.

A piston 38 is slidably fitted in a cylinder bore 39 formed in the cylinder block 23. A combustion chamber 40 is formed between the cylinder block 23 and the cylinder head 24 which the top of the piston 38 faces.

An intake port 41 and an exhaust port 42 are formed in the cylinder head 24 and communicate with the combustion chamber 40. An intake valve 43 and an exhaust valve 44 are arranged in the cylinder head 24. The intake valve 43 opens and closes communication between the intake port 41 and the combustion chamber 40. The exhaust valve 44 opens and closes communication between the exhaust port 42 and the combustion chamber 40. A spark plug 45 is screwed into the cylinder head 24 and has electrodes facing the combustion chamber 40.

The carburetor 34 is connected to an upper part of the cylinder head 24. The downstream end of an intake passage 46 of the carburetor 34 communicates with the intake port 41. An intake pipe 47 communicating with the upstream end of the intake passage 46 is connected to the carburetor 34. The intake pipe 47 is also connected to an air cleaner (not illustrated). An exhaust pipe 48 communicating with the exhaust port 42 is connected to an upper part of the cylinder head 24. The exhaust pipe 48 is also connected to an exhaust muffler 49. A fuel tank 51, which is supported by a bracket 50 projecting from the crankcase 22, is disposed above the crankcase 22.

A drive gear 52 is fixedly provided on the crankshaft 27 near the side cover 26 of the crankcase 22. A driven gear 53 that meshes with the drive gear 52 is fixedly attached to a rotating shaft 54 having an axis parallel to the crankshaft 27. Opposite ends of the rotating shaft 54 are rotatably carried on the crankcase 22, which includes the case main body 25 and the side cover 26, via ball bearings 55, 56. Rotational power from the crankshaft 27 is transmitted to the rotating shaft 54 at a reduction ratio of ½ via the meshed drive gear 52 and the driven gear 53.

A valve operating mechanism 66, which opens and closes the intake valve 43 and the exhaust valve 44, includes an intake cam 57, an exhaust cam 58, lifters 59, 60, pushrods 62, 63, and rocker arms 64, 65, which are provided between the pushrods 62, 63 and the intake and exhaust valves 43, 44. The intake cam 57 and the exhaust cam 58 are rotated by the crankshaft 27 at a reduction ratio of ½. The lifters 59, 60 are in sliding contact with the cams 57, 58. The pushrods 62, 63 are pushed by the lifters 59, 60.

Figure 4:
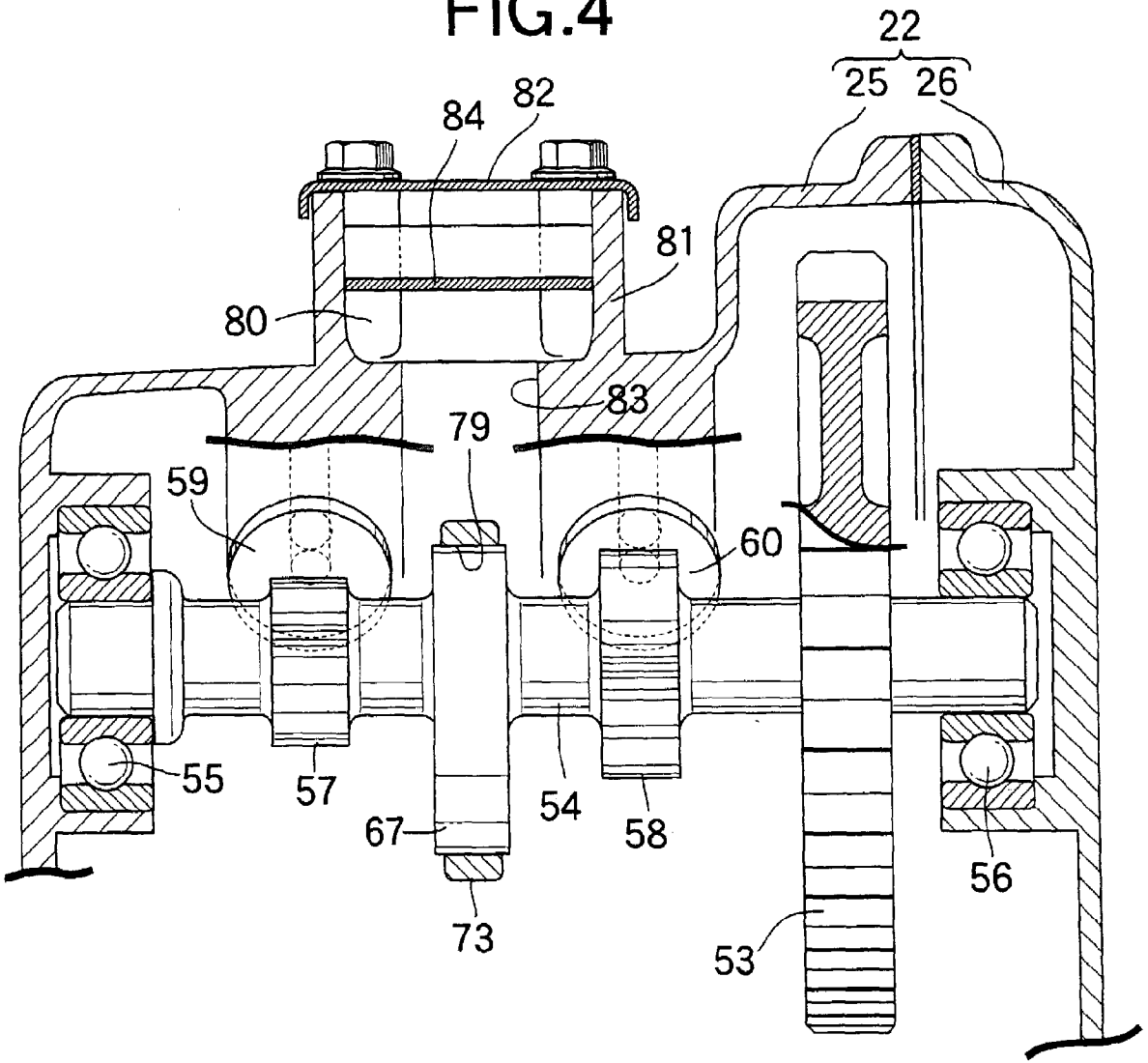
FIG. 4 is a magnified cross-sectional view of the engine shown in FIG. 1, taken along line 4—4 in FIG. 2.

Referring also to FIG. 4, the intake cam 57 and the exhaust cam 58, which correspond to the intake valve 43 and the exhaust valve 44, respectively, are provided on the rotating shaft 54. The lifters 59, 60 are operably supported in the cylinder block 23 and are in sliding contact with the intake cam 57 and the exhaust cam 58. An operating chamber 61 is formed in the cylinder block 23 and the cylinder head 24. Upper parts of the lifters 59, 60 project into a lower part of the operating chamber 61. The lower ends of the pushrods 62, 63 disposed within the operating chamber 61 abut against the lifters 59, 60. Rocker arms 64, 65 are rockably carried in the cylinder head 24. One end of each rocker arm 64 and 65 abuts against the upper end of a corresponding one of the intake valve 43 and the exhaust valve 44, which are spring-biased in a valve-closing direction. The upper end of each pushrod 62 and 63 abuts against the other end of the corresponding one of the rocker arms 64 and 65.

In the valve operating mechanism 66, the pushrods 62, 63 move in the axial direction as the intake cam 57 and the exhaust cam 58 rotate. The resulting rocking of the rocker arms 64 and 65 opens and closes the intake valve 43 and the exhaust valve 44.

Figure 5:
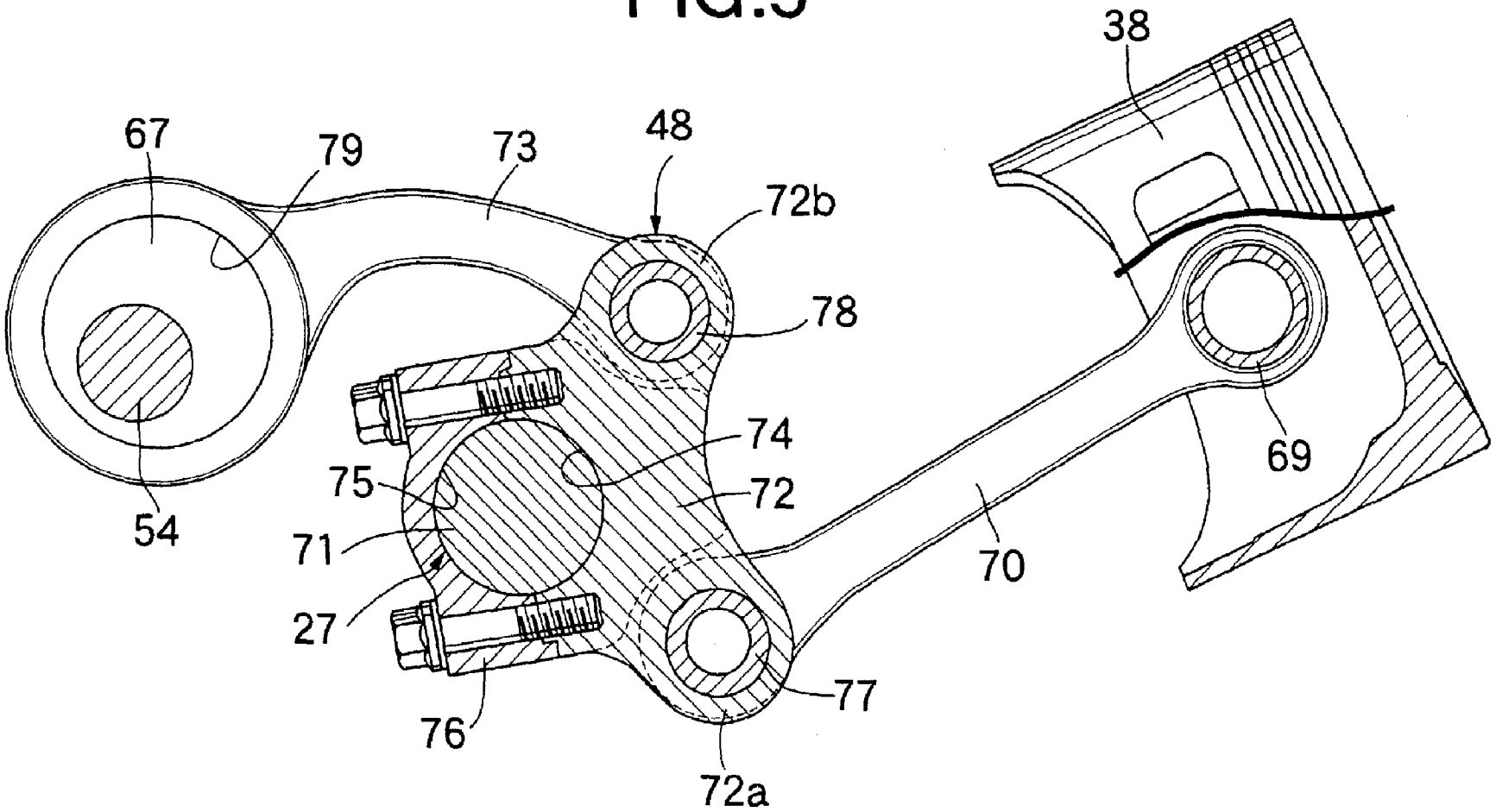
FIG. 5 is a magnified cross-sectional view of the engine shown in FIG. 1, taken along line 5—5 in FIG. 3.

Referring to FIG. 5, an eccentric shaft 67 provided at a position eccentric relative to the rotating shaft 54, the piston 38, and the crankshaft 27 are connected to each other via a link mechanism 68.

The link mechanism 68 is formed from a connecting rod 70, a sub-rod 72, a control rod 73, and the eccentric shaft 67. One end of the connecting rod 70 is connected to the piston 38 via a piston pin 69, the sub-rod 72 is connected to the crankshaft 27 via a crankpin 71 and to the other end of the connecting rod 70, one end of the control rod 73 is connected to the sub-rod 72 at a position away from the position where the connecting rod 70 is connected, and the eccentric shaft 67 is connected to the other end of the control rod 73.

The sub-rod 72 has in its middle portion a semicircular first bearing 74 that is in sliding contact with half of the periphery of the crankpin 71. Integrally provided at opposite ends of the sub-rod 72 are a pair of bifurcated portions 72*a*, 72*b* sandwiching the other end of the connecting rod 70 and the one end of the control rod 73, respectively. The remaining half of the periphery of the crankpin 71 is in sliding contact with a semicircular second bearing 75 of a crank cap 76. The crank cap 76 is secured to the sub-rod 72.

The other end of the connecting rod 70 is inserted into the bifurcated portion 72*a* at one end of the sub-rod 72 and is swingably connected to the one end of the sub-rod 72 via a connecting rod pin 77. Opposite ends of the connecting rod pin 77, which is press-fitted in the other end of the connecting rod 70, are swingably fitted in the bifurcated portion 72*a* at the one end of the sub-rod 72.

The one end of the control rod 73 is inserted into the bifurcated portion 72*b* at the other end of the sub-rod 72 and is swingably connected to the sub-rod 72 via a sub-rod pin 78. The sub-rod pin 78 runs relatively swingably through the one end of the control rod 73. Opposite ends of the sub-rod pin 78 are swingably supported in the bifurcated portion 72*a* at the other end of the sub-rod 72.

The eccentric shaft 67 is integrally formed on the rotating shaft 54 and is positioned between the intake cam 57 and the exhaust cam 58. The eccentric shaft 67 has a diameter that covers the entirety of either one of the intake cam 57 and the exhaust cam 58 when viewed from a direction along the axis of the rotating shaft 54. A circular shaft hole 79 is provided at the other end of the control rod 73. The eccentric shaft 67 is relatively slidably fitted within the hole 79.

As the eccentric shaft 67 rotates at a reduction ratio of ½ relative to the rotation of the crankshaft 27, the link mechanism 68 operates so that the stroke of the piston 38 during expansion is larger than the stroke during compression. Accordingly, a greater amount of expansion work is carried out with the same amount of intake mixture, thereby enhancing the cycle thermal efficiency.

A tube-shaped breather chamber 80 is formed in the engine main body 21 above the eccentric shaft 67 of the rotating shaft 54. That is, integrally provided on the case main body 25 of the crankcase 22 of the engine main body 21 is a rectangular breather housing 81 which projects upward. The breather housing 81 and a cover plate 82 secured thereto, wherein the cover plate 82 blocks an opening at the outer end of the breather housing 81, form the breather chamber 80. The breather chamber 80 communicates with the interior of the crankcase 22 via an inlet 83 provided in the case main body 25 in a section corresponding to the eccentric shaft 67.

A baffle plate 84 supported on the cover plate 82 forms a labyrinth within the breather chamber 80. Breather gas that has passed through the labyrinth is discharged, for example, through an outlet 85 provided in the breather housing 81, and is guided to an air cleaner via a pipe (not illustrated).

Oil that is entrained in the breather gas is subjected to gas-liquid separation while passing through the labyrinth. The oil that has been separated and collected in a lower part of the breather chamber 80 drops into the interior of the crankcase 22 through an oil supply hole 86 provided in the case main body 25 at a position adjacent to the inlet 83 so that the oil drops onto the eccentric shaft 67.

The operation of the present invention will now be explained. The intake and exhaust cams 57, 58 forming a part of the valve operating mechanism 66 are provided on the rotating shaft 54 having the eccentric shaft 67. Power from the crankshaft 27 is transmitted to the rotating shaft 54 at a reduction ratio of ½. Therefore, it is unnecessary to use a camshaft in addition to the rotating shaft 54, thus reducing the number of structural components, and space is not required to be provided to arrange the camshaft, thereby reducing the overall dimensions of the engine. Since a dedicated camshaft is not needed, a power transfer mechanism between the crankshaft 27 and the dedicated camshaft is not required, thereby reducing the mechanical noise and the friction loss.

Integrally provided on the rotating shaft 54 is the intake cam 57, the exhaust cam 58, and the eccentric shaft 67 disposed between the intake and exhaust cams 57 and 58. The eccentric shaft 67 has a diameter that covers the entire shape of either one of the intake cam 57 and the exhaust cam 58 when viewed from a direction along the axis of the rotating shaft 54. As a result, the eccentric shaft 67 can be provided on the rotating shaft 54 without using a crank arrangement for the rotating shaft 54, the machining precision of the eccentric shaft 67 and the intake and exhaust cams 57 and 58 is improved, and the rotating shaft is formed with relatively low weight and increased rigidity.

Formed in the case main body 25 of the crankcase 22 of the engine main body 21 above the eccentric shaft 67 are the breather chamber 80 and the oil supply hole 86 through which the oil drops onto the eccentric shaft 67, the oil being separated from the breather gas by gas-liquid separation within the breather chamber 80.

The oil separated from the breather gas within the breather chamber 80 drops onto the eccentric shaft 67, so that lubrication can be provided between the eccentric shaft 67 and the control rod 73 while eliminating the need for a lubricating device exclusively used for the eccentric shaft 67, thereby reducing the overall dimensions and the weight of the engine.

Although a preferred embodiment of the present invention is explained above, the invention is not limited to the above-mentioned description and can be modified in a variety of ways without departing from the present invention described in the scope of claims.

What is claimed is:

1. A variable stroke engine comprising:

a connecting rod having one end connected to a piston via a piston pin;

a sub-rod connected to a crankshaft via a crankpin and connected to the other end of the connecting rod;

a control rod connected at one end to the sub-rod at a position distal from a position where the sub-rod is connected to the connecting rod, the control rod having an arcuate body and a shaft hole defined at the other end of the control rod; and an eccentric shaft connected to the other end of the control rod, wherein the eccentric shaft is provided at a position eccentric relative to a rotating shaft to which power is transmitted from the crankshaft at a reduction ratio of ½, wherein an intake cam and an exhaust cam, which are separate and distinct from each other, are provided on the rotating shaft, wherein the valve operating mechanism includes the intake cam, the exhaust cam, first and second lifters, first and second pushrods, and first and second rocker arms, wherein the first pushrod is provided between the intake cam and the first rocker arm, and the second pushrod is provided between the exhaust cam and the second rocker arm, wherein the intake cam, the exhaust cam, and the eccentric shaft, which is disposed between the intake and exhaust cams, are integrally provided on the rotating shaft, and wherein outer diameters of the eccentric and rotating shafts are substantially equal to or less than an inner diameter of the shaft hole defined at the other end of the control rod and the outer diameter of the eccentric shaft covers an entirety of one of the intake and exhaust cams when viewed from a direction along an axis of the rotating shaft.

2. The variable stroke engine according to claim 1, wherein the intake and exhaust cams are rotated by the crankshaft at a reduction ratio of ½.

3. The variable stroke engine according to claim 1, wherein the first and second lifters are in sliding contact with the intake and exhaust cams, respectively, and push the first and second pushrods, respectively.

4. The variable stroke engine according to claim 1, wherein the first and second pushrods move in an axial direction orthogonal relative to an axis of the rotating shaft as the intake and exhaust cams rotate.

5. The variable stroke engine according to claim 1, wherein a middle portion of the sub-rod includes a semicircular bearing in sliding contact with a first periphery half of the crankpin connecting the sub-rod to the crankshaft.

6. The variable stroke engine according to claim 5, wherein a second periphery half of the crankpin is in sliding contact with a semicircular bearing of a crank cap secured to the sub-rod.

7. The variable stroke engine according to claim 1, wherein opposite ends of the sub-rod include first and second bifurcated portions, respectively, wherein one end of the sub-rod swingably secures the other end of the connecting rod and the other end of the sub-rod swingably secures the one end of the control rod.

8. The variable stroke engine according to claim 7, wherein a connecting rod pin swingably connects the other end of the connecting rod to the one end of the sub-rod and a sub-rod pin swingably connects the one end of the control rod to the other end of the sub-rod.

9. The variable stroke engine according to claim 1, wherein an expansion stroke of the piston is larger than a compression stroke of the piston.

10. The variable stroke engine according to claim 1, further comprising a breather chamber provided above the eccentric shaft of the rotating shaft.

11. The variable stroke engine according to claim 10, wherein the breather chamber includes a breather housing and a cover plate secured thereto, wherein the cover plate blocks an opening of the breather housing.

12. The variable stroke engine according to claim 11, wherein a baffle plate is supported on the cover plate and separates oil therein from a breather gas that passes through the baffle plate.

13. The variable stroke engine according to claim 12, wherein the separated oil is directed onto the eccentric shaft.

14. The variable stroke engine according to claim 1 wherein the outer diameter of the eccentric shaft is larger than that of the rotating shaft.

15. A variable stroke engine comprising:

a connecting rod having one end connected to a piston via a piston pin;

a sub-rod connected to a crankshaft via a crankpin and connected to the other end of the connecting rod;

a control rod connected at one end to the sub-rod at a position distal from a position where the sub-rod is connected to the connecting rod, the control rod having an arcuate body and a shaft hole defined at the other end of the control rod; and an eccentric shaft connected to the other end of the control rod, wherein the eccentric shaft is provided at a position eccentric relative to a rotating shaft to which power is transmitted from the crankshaft at a reduction ratio of ½, wherein at least one of an intake cam and an exhaust cam of a valve operating mechanism is provided on the rotating shaft, and wherein the valve operating mechanism includes the intake cam, the exhaust cam, first and second lifters, first and second pushrods, and first and second rocker arms, wherein the first pushrod is provided between the intake cam and the first rocker arm, and the second pushrod is provided between the exhaust cam and the second rocker arm, wherein the intake cam, the exhaust cam, and the eccentric shaft, which is disposed between the intake and exhaust cams, are integrally provided on the rotating shaft, and wherein outer diameters of the eccentric and rotating shafts are substantially equal to or less than an inner diameter of the shaft hole defined at the other end of the control rod and the outer diameter of the eccentric shaft covers an entirety of one of the intake and exhaust cams when viewed from a direction along an axis of the rotating shaft.

16. The variable stroke engine according to claim 15, wherein the intake and exhaust cams are rotated by the crankshaft at a reduction ratio of ½.

17. The variable stroke engine according to claim 15, wherein the first and second lifters are in sliding contact with the intake and exhaust cams, respectively, and push the first and second pushrods, respectively.

18. The variable stroke engine according to claim 15, wherein the first and second pushrods move in an axial direction orthogonal relative to an axis of the rotating shaft as the intake and exhaust cams rotate.

19. The variable stroke engine according to claim 15, wherein a middle portion of the sub-rod includes a semicircular bearing in sliding contact with a first periphery half of the crankpin connecting the sub-rod to the crankshaft.

20. The variable stroke engine according to claim 19, wherein a second periphery half of the crankpin is in sliding contact with a semicircular bearing of a crank cap secured to the sub-rod.

21. The variable stroke engine according to claim 15, wherein opposite ends of the sub-rod include first and second bifurcated portions, respectively, wherein one end of the sub-rod swingably secures the other end of the connecting rod and the other end of the sub-rod swingably secures the one end of the control rod.

22. The variable stroke engine according to claim 21, wherein a connecting rod pin swingably connects the other end of the connecting rod to the one end of the sub-rod and a sub-rod pin swingably connects the one end of the control rod to the other end of the sub-rod.

23. The variable stroke engine according to claim 15, wherein an expansion stroke of the piston is larger than a compression stroke of the piston.

24. The variable stroke engine according to claim 15 wherein the outer diameter of the eccentric shaft is larger than that of the rotating shaft.

25. A variable stroke engine comprising:

a connecting rod having one end connected to a piston via a piston pin;

a sub-rod connected to a crankshaft via a crankpin and connected to the other end of the connecting rod;

a control rod connected at one end to the sub-rod at a position distal from a position where the sub-rod is connected to the connecting rod, the control rod having an arcuate body and a shaft hole defined at the other end of the control rod;

an eccentric shaft connected to the other end of the control rod, wherein the eccentric shaft is provided at a position eccentric relative to a rotating shaft to which power is transmitted from the crankshaft at a reduction ratio of ½; and a breather chamber provided above the eccentric shaft of the rotating shaft, wherein at least one of an intake cam and an exhaust cam of a valve operating mechanism is provided on the rotating shaft, and wherein the intake cam, the exhaust cam, and the eccentric shaft, which is disposed between the intake and exhaust cams, are integrally provided on the rotating shaft, and wherein outer diameters of the eccentric and rotating shafts are substantially equal to or less than an inner diameter of the shaft hole defined at the other end of the control rod and the outer diameter of the eccentric shaft covers an entirety of one of the intake and exhaust cams when viewed from a direction along an axis of the rotating shaft.

26. The variable stroke engine according to claim 25, wherein the valve operating mechanism includes the intake cam, the exhaust cam, first and second lifters, first and second pushrods, and first and second rocker arms, wherein the first pushrod is provided between the intake cam and the first rocker arm, and the second pushrod is provided between the exhaust cam and the second rocker arm.

27. The variable stroke engine according to claim 26, wherein the intake and exhaust cams are rotated by the crankshaft at a reduction ratio of ½.

28. The variable stroke engine according to claim 26, wherein the first and second lifters are in sliding contact with the intake and exhaust cams, respectively, and push the first and second pushrods, respectively.

29. The variable stroke engine according to claim 26, wherein the first and second pushrods move in an axial direction orthogonal relative to an axis of the rotating shaft as the intake and exhaust cams rotate.

30. The variable stroke engine according to claim 25, wherein a middle portion of the sub-rod includes a semicircular bearing in sliding contact with a first periphery half of the crankpin connecting the sub-rod to the crankshaft.

31. The variable stroke engine according to claim 30, wherein a second periphery half of the crankpin is in sliding contact with a semicircular bearing of a crank cap secured to the sub-rod.

32. The variable stroke engine according to claim 25, wherein opposite ends of the sub-rod include first and second bifurcated portions, respectively, wherein one end of the sub-rod swingably secures the other end of the connecting rod and the other end of the sub-rod swingably secures the one end of the control rod.

33. The variable stroke engine according to claim 32, wherein a connecting rod pin swingably connects the other end of the connecting rod to the one end of the sub-rod and a sub-rod pin swingably connects the one end of the control rod to the other end of the sub-rod.

34. The variable stroke engine according to claim 25, wherein an expansion stroke of the piston is larger than a compression stroke of the piston.

35. The variable stroke engine according to claim 25, wherein the breather chamber includes a breather housing and a cover plate secured thereto, wherein the cover plate blocks an opening of the breather housing.

36. The variable stroke engine according to claim 35, wherein a baffle plate is supported on the cover plate and separates oil therein from a breather gas that passes through the baffle plate.

37. The variable stroke engine according to claim 36, wherein the separated oil is directed onto the eccentric shaft.

38. The variable stroke engine according to claim 25 wherein the outer diameter of the eccentric shaft is larger than that of the rotating shaft.

* * * * *